US008043177B2

(12) United States Patent
Flanagan

(10) Patent No.: US 8,043,177 B2
(45) Date of Patent: Oct. 25, 2011

(54) ARROWHEAD HAVING COLLAPSIBLE AND OUTWARDLY BIASED BLADES

(76) Inventor: Edward Flanagan, Oakley, MI (US)

( * ) Notice: Subject to any disclaimer, the term of this patent is extended or adjusted under 35 U.S.C. 154(b) by 630 days.

(21) Appl. No.: 12/168,189

(22) Filed: Jul. 7, 2008

(65) Prior Publication Data

US 2010/0004078 A1 Jan. 7, 2010

(51) Int. Cl.
*F42B 6/08* (2006.01)

(52) U.S. Cl. ..... 473/583

(58) Field of Classification Search ..... 473/582, 473/583, 584

See application file for complete search history.

(56) References Cited

U.S. PATENT DOCUMENTS 3,036,395 A * 5/1962 Erlo ..... 43/6
3,036,396 A 5/1962 Swails
4,099,720 A 7/1978 Zeren
4,973,060 A * 11/1990 Herzing ..... 473/583
5,879,252 A 3/1999 Johnson
6,270,435 B1 8/2001 Sodaro
6,287,224 B1 9/2001 Liechty, II
6,554,727 B1 * 4/2003 Armstrong et al. ..... 473/584
6,758,774 B2 7/2004 Liechty, II
6,793,596 B1 9/2004 Sullivan et al.
6,830,523 B1 12/2004 Kuhn
7,311,622 B1 12/2007 Futtere
7,713,152 B1 * 5/2010 Tentler et al. ..... 473/583

* cited by examiner

*Primary Examiner* — John Ricci
(74) *Attorney, Agent, or Firm* — Gifford, Krass, Sprinkle, Anderson & Citkowski, P.C.; Douglas L. Wathen

(57) ABSTRACT

A broadhead for an arrow has a ferrule and a pair of blade members. Each blade member has a first end that is pivotally interconnected with the ferrule body and an opposite second end. The blade members each have a retracted position and an extended position. A biasing member biases the blade members toward the extended positions and is the only element operable to hold the blade members in the extended position.

17 Claims, 4 Drawing Sheets

ARROWHEAD HAVING COLLAPSIBLE AND OUTWARDLY BIASED BLADES

FIELD OF THE INVENTION

The invention relates to arrowheads and, more particularly, to arrowheads with blade members that are collapsible to allow the arrow to pass through bone and outwardly biased to increase the amount of flesh cut by the blade members after passing through the bone.

BACKGROUND OF THE INVENTION

Many hunters attempt to shoot an animal through the shoulder blade in hopes that the arrow will pass therethrough and penetrate the animal's heart and/or lungs. This results in a fast kill and minimizes the amount of suffering experienced by the animal. Conventional blade designs are known, which purport to penetrate flesh and pass cleanly through bone to continue penetrating flesh on the other side. Yet, in use in the field, it is widely known that these designs do not reliably ensure clean penetration of the bone. In many instances, conventional arrowhead designs gets stuck in the bone, which results in an animal that is wounded but not mortally wounded. Such an animal may suffer and/or run away to escape capture by the hunter.

Thus, it remains desirable to provide an improved arrow and arrowhead design that provides reliable penetration of bone and maximizes cutting of soft flesh on either side of the bone to increase the likelihood of a successful kill and minimize undue suffering of the animal.

SUMMARY OF THE INVENTION

According to one embodiment of the invention, a broadhead for an arrow with a shaft includes a ferrule and first and second blade members. The ferrule has a rearward end configured for attachment to the shaft of the arrow and an opposite forward end with a ferrule body extending therebetween. The first blade member has a first end pivotally interconnected with the ferrule body and an opposite second end. The first blade member has a retracted position wherein the second end is spaced from the ferrule body at a first distance and an extended position wherein the second end is spaced from the ferrule body by a distance which is greater than the first distance. The second blade member has a first end pivotally interconnected with the ferrule body and an opposite second end. The first blade number has a retracted position wherein the second end is spaced from the ferrule body at a first distance and an extended position wherein the second end is spaced from the ferrule body by a distance which is greater than the first distance. The broadhead also includes at least one biasing member for biasing the first and second blade members towards the extended positions. The biasing member is the only element operable to hold the blade members in the extended position.

In some versions, the pivotal interconnection between the first blade member and the ferrule body is at a fixed position relative to the ferrule body and the pivotal interconnection between the second blade member and the ferrule body is at a fixed position relative to the ferrule body. In some versions, the pivotal interconnections are each substantially equidistant from the forward end of the ferrule.

According to another embodiment of the invention, a broadhead has a ferrule, a pair of blade members and at least one biasing member. The ferrule has a rearward end configured for attachment to the shaft of an arrow and an opposite forward end with the ferrule body extending therebetween.

The first blade member has a forward end pivotally interconnected with the ferrule body and an opposite rearward end. The first blade member has a retracted position wherein the rearward end is spaced from the ferrule body at a first distance and an extended position wherein the rearward end is spaced from the ferrule body by a second distance which is greater than the first distance. The pivotal interconnection between the first blade member and the ferrule body is at a fixed position relative to the ferrule body. The second blade member has a forward end pivotally interconnected with the ferrule body and a rearward end. The second blade member has a retracted position wherein the rearward end is spaced from the ferrule body at a first distance and an extended position wherein the rearward end is spaced from the ferrule body by a distance which is greater than the first distance. The pivotal interconnection between the second blade member and the ferrule body is at a fixed position relative to the ferrule body. The biasing member biases the first and second blade members towards the extended positions.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

Figure 1:
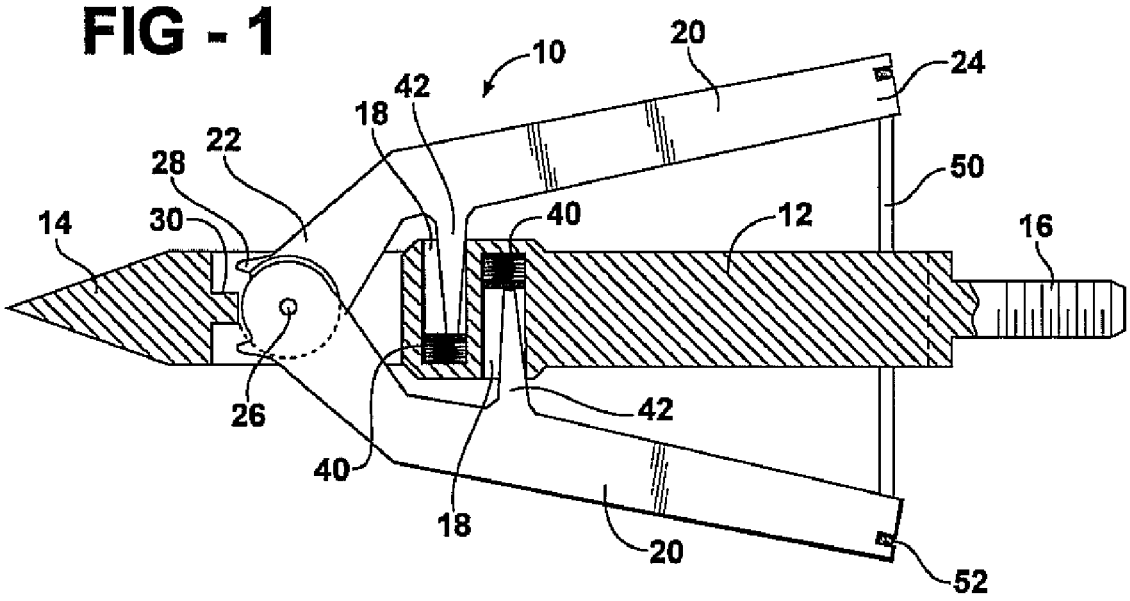
FIG. 1 is a cross sectional side view of a broadhead according to a first embodiment of the present invention with the blade members in a retracted position.
Figure 2:
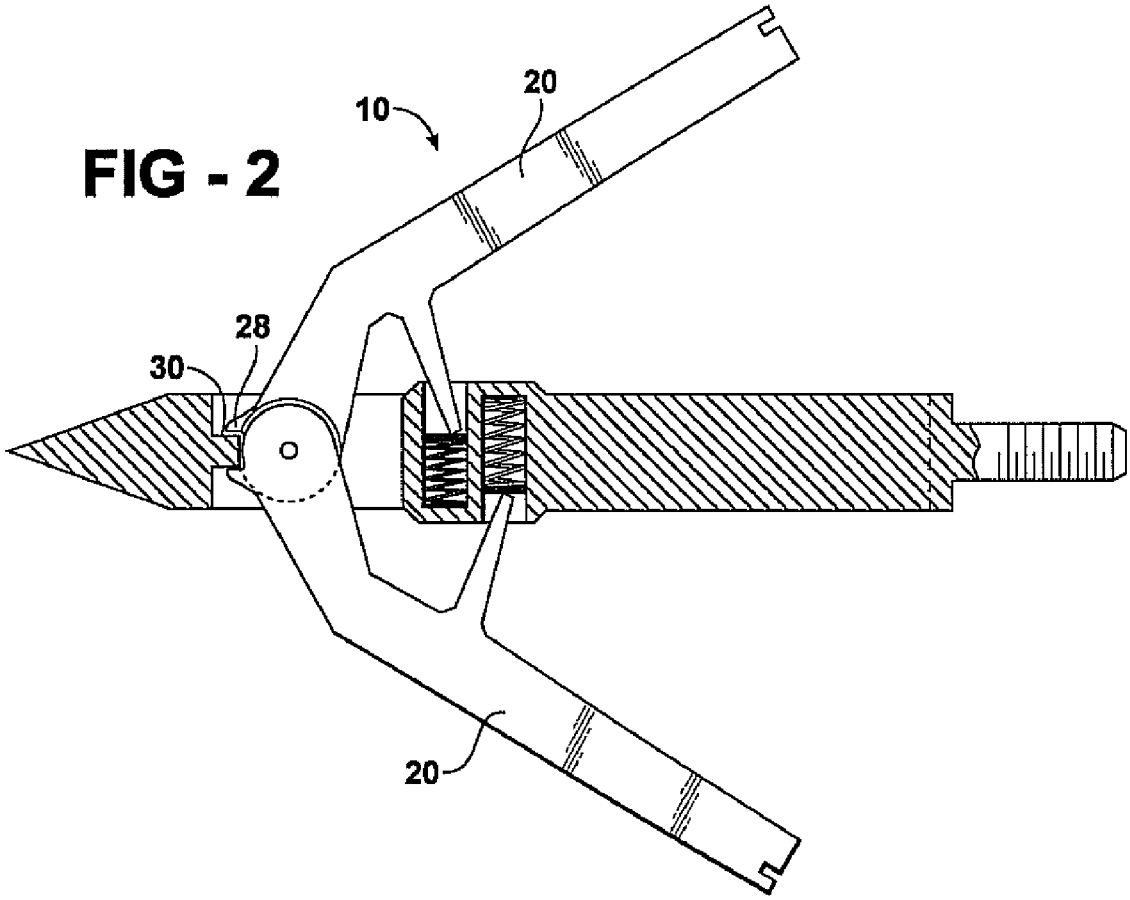
FIG. 2 is a view similar to FIG. 1 with the blade members in an extended position.

Referring to FIGS. 1 and 2, an arrowhead according to one embodiment of the invention is generally indicated at 10. This type of arrowhead is generally referred to as a broadhead. The arrowhead 10 includes a generally cylindrical body or ferrule 12. A pointed tip 14 is formed at the forward end of the ferrule 12 and an attachment portion 16 is formed at the rearward end of the ferrule 12. The portion between the ends may be called a ferrule body.

The arrowhead 10 includes at least one blade member 20 movably coupled to the ferrule 12 for movement between a retracted position, as shown in FIG. 1, and an extended position, as shown in FIG. 2. Preferably, blade members 20 are provided in generally symmetrically opposite pairs, e.g. two or four blade members spaced equidistantly in a rotational sense about the ferrule 12, though an odd number is also possible. A front end 22 of each blade member 20 is movably coupled to the ferrule 12 nearer to the tip 14 than the attachment portion 16. In the retracted position, the length of the blade member 20 is disposed along side of or adjacent to the ferrule 12. In the extended position, the blade member 20 is generally rotated forwardly so that a rear end 24 of the blade member 20 is spaced apart from the ferrule 12. In the retracted position, the rear end 24 of the blade member may be said to be spaced from the ferrule 12 by a first distance and in the extended position the rear end 24 may be said to spaced from the ferrule by a distance greater than the first distance.

In the illustrated embodiment, the front end 22 of the blade member 20 is pivotally coupled to the ferrule 12 for movement about a fixed pivot 26 between the retracted and extended positions. A tab 28 extends outwardly from the front end 22 of each blade member 20 and contacts an abutting surface 30 on the ferrule to limit outward travel for the blade member 20 and define the extended position of the blade member 20. Alternatively, the travel limit provided by the tab 28 and abutting surface 30 may be provided in other ways, or there may not be a travel limit. Also, any position of the blade members 20 wherein the rear ends 24 are spaced from the ferrule by a distance greater than the first distance may be considered to be the extended position even if the travel limit is not reached.

It should be appreciated that the front end 22 of the blade members 20 may be coupled to the ferrule 12 near the tip 14 by other arrangements, such as by a pivot pin pivotally and/or slidably coupled in a slot. The pin and slot may be provided interchangeably on the ferrule and blade member. It should also be appreciated that FIGS. 1 and 2 are cross sectional views and the forward ends of the blade members are disposed in a slot formed in the ferrule body. The slot may have a different shape than illustrated, and may allow more of the blade members to nest into the slot in the retracted position.

A biasing member 40 continuously biases each blade member toward the extended position. In this embodiment, the ferrule 12 has a pair of spring-receiving bores 18 defined therein and the biasing members 40 are coil springs disposed in the bores. The blade members 20 each further include an arm 42 that engages one of the springs 40. In the retracted position, the arms 42 extend into the bores 18 and compress the springs 40. The springs 40 expand, thereby pushing the arms 42 and blade members 20 outwardly as the blade members move to the extended position.

Preferably, a retaining element 50 initially retains the blade members 20 in the retracted position, as shown in FIG. 1. The retaining element may take the form or a metal plastic or elastomer ring that engages recesses 52 in the second end of the blade members. Alternatively, the ring may be wrapped about the second end 24 of the blade members. As a further alternative, each blade member may have its own retaining element. As yet a further alternative, the retaining element may take other forms such as a lever or latch that initially retains the blade members 20 in the retracted position. As will be described in further detail below, the retaining element 50 is designed to disengage from the blade members 20 when the broadhead 10 punctures a target. For example, the material penetrated by the broadhead may push the retaining element 50 rearwardly to disengage it from the blade members.

In assembly, the arrowhead 10 is fixedly secured to an end of a longitudinally extending shaft forming a body of an arrow. In the illustrated embodiment, the attachment portion 16 of the arrowhead 10 is a threaded male portion that is threaded into a threaded receiving hole formed in the end of the rod. It should be appreciated that other attachment arrangements may be provided for fixedly securing the arrowhead to the rod.

In use, the arrow 60 is fired toward an animal. The blade members 20 are preferably initially maintained in the retracted position as the arrow is in flight toward the animal. The retracted position reduces the size of the broadhead thereby increasing accuracy. As the tip 14 and blade members 20 penetrate the skin of the animal the blade members 20 remain in the retracted position until the retaining element 50 is removed by the penetration. The blade members are then urged to the extended position due to the outward bias of the biasing members 40. As the tip 14 and blade members 20 encounter a bone in the animal, such as a shoulder blade, the blade members 20 collapse toward the retracted position to allow the arrow to continue progress through the bone. As the ferrule 12 passes through the bone, the blade members 20 return to the extended position due to the force applied by the biasing member 40. The biasing member 40 is provided with a predetermined spring force that allows the blade members 20 to move to the retracted position as the ferrule 12 passes through the bone and to return to the extended position after the ferrule 12 has passed through the bone. Thus, the blade members 20 are in the extended position on either side of the bone to maximize the cutting surface of the arrowhead 10 through the soft flesh of the animal.

Figure 3:
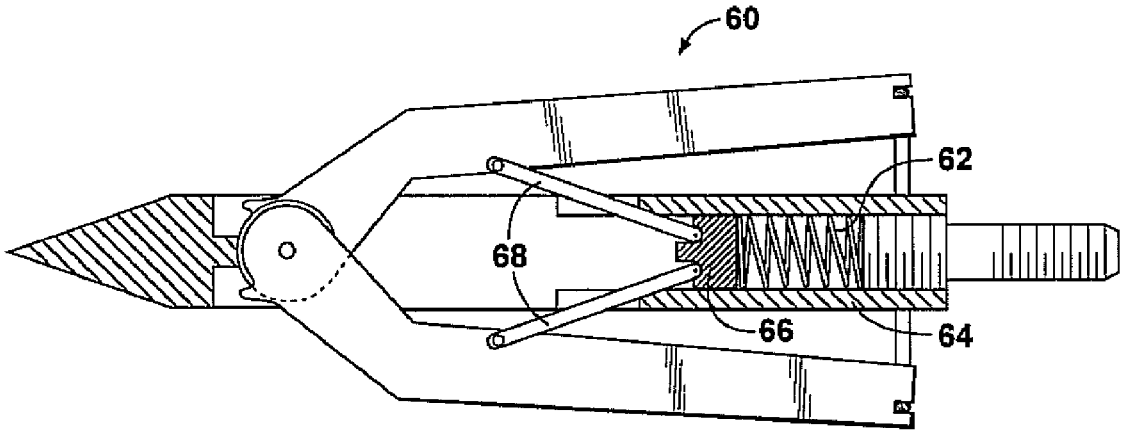
FIG. 3 is a cross sectional side view of a broadhead according to a second embodiment of the present invention with the blade members in a retracted position.
Figure 4:
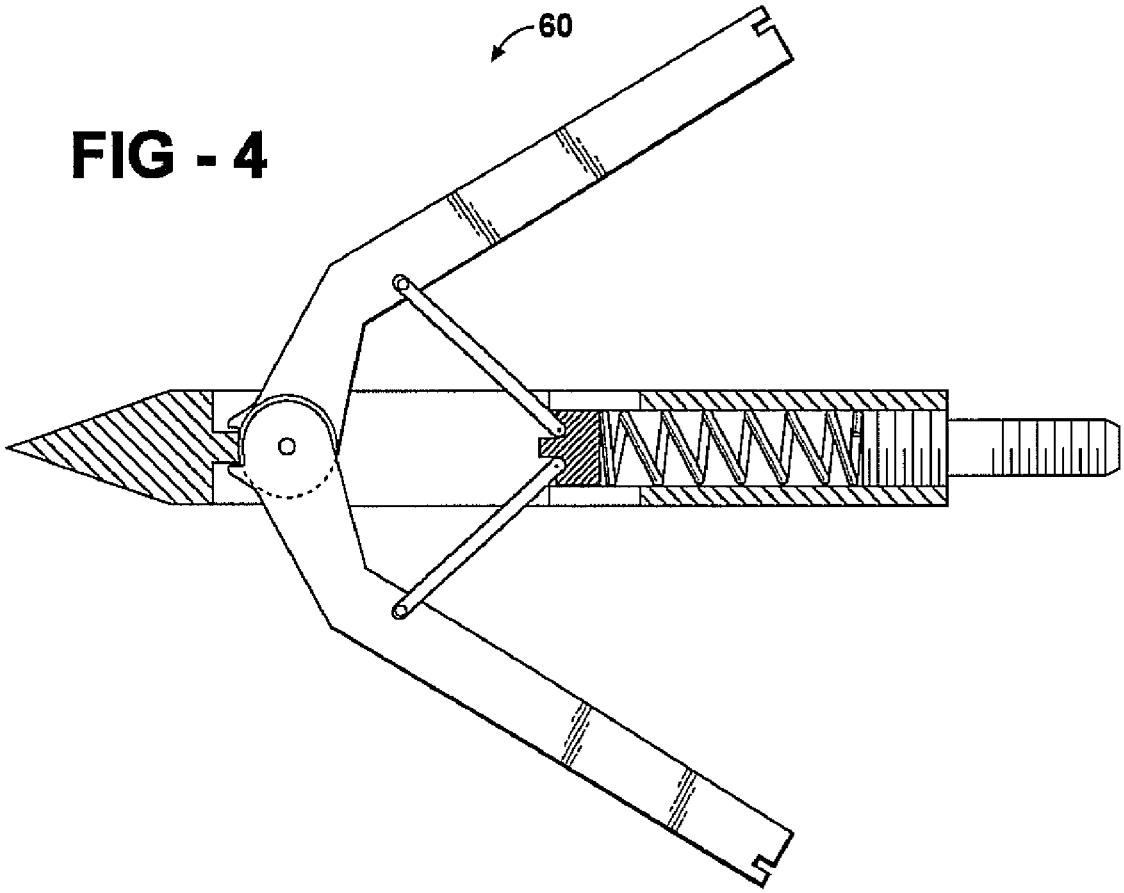
FIG. 4 is a view similar to FIG. 3 with the blade members in an extended position.

Referring now to FIGS. 3 and 4, a second embodiment of an arrowhead according to the present invention is generally shown at 60. This embodiment is similar to the embodiment of FIGS. 1 and 2. However, it differs from the earlier embodiment in that the biasing member 62 is disposed in a central axial bore of the ferrule 64. The biasing member 62 engages a sliding element 66 which is also disposed in the bore. Articulating arms 68 interconnect the sliding element 66 with the blade members so as to bias them from the retracted position shown in FIG. 3 to the extended position shown in FIG. 4.

Figure 5:
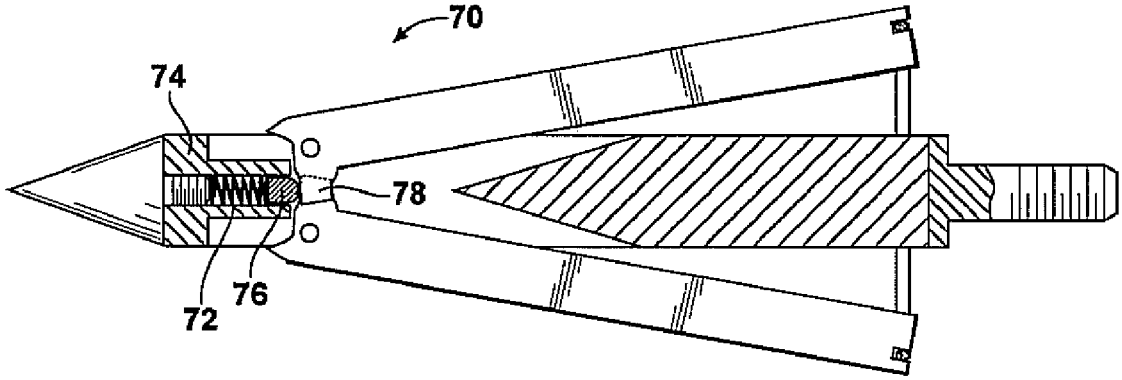
FIG. 5 is a cross sectional side view of a broadhead according to a third embodiment of the present invention with the blade members in a retracted position.
Figure 6:
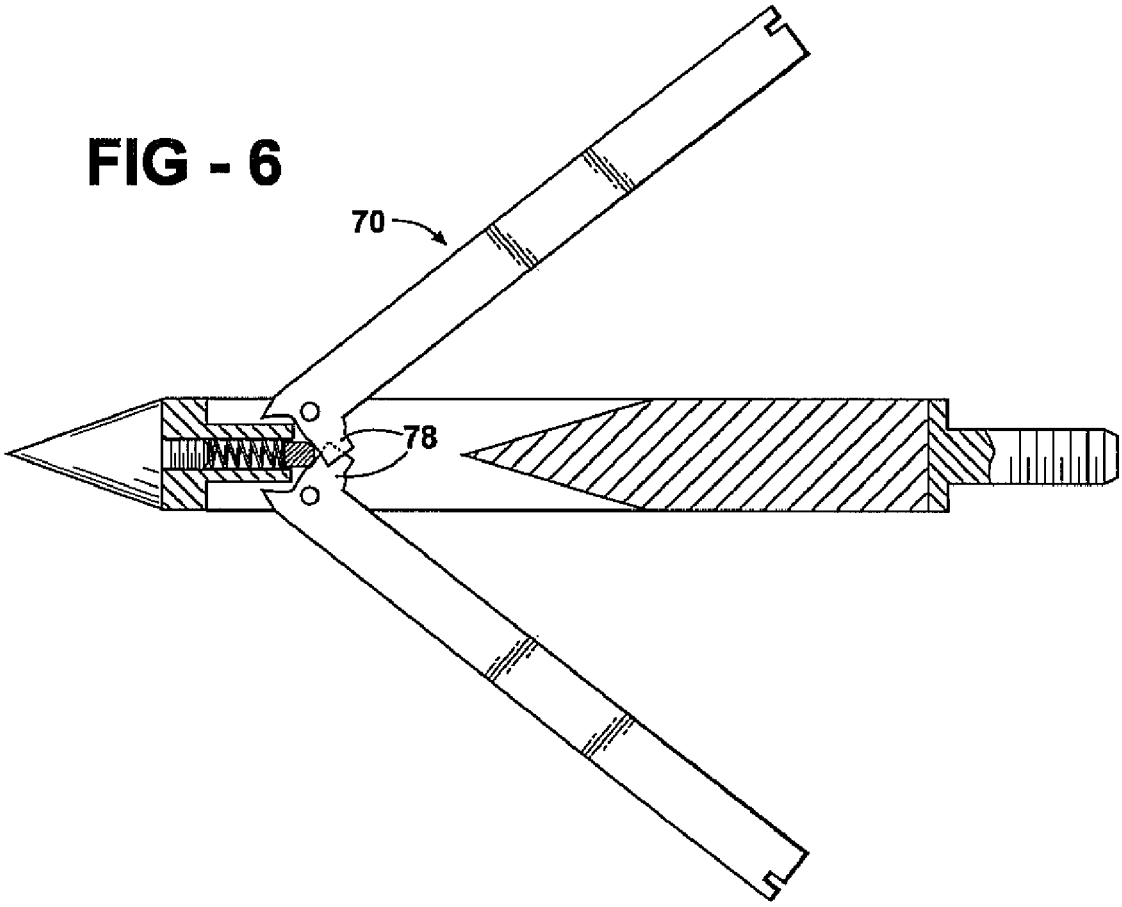
FIG. 6 is a view similar to FIG. 5 with the blade members in an extended position.

Referring now to FIGS. 5 and 6, a third embodiment of an arrowhead according the present invention is generally shown as 70. This embodiment differs from the earlier embodiments in that the biasing member 72 is disposed in a coaxial bore adjacent the forward end of the ferrule 74. The biasing member is illustrated as a coil spring which engages a sliding element 76 also disposed in the bore. The sliding element 76 engages inwardly extending tabs 78 on the blade members. These tabs 78 extend inwardly from the pivotal connection between the blade members and the ferrule. By pushing rearwardly on the tabs 78, the sliding element 76 urges the blade members outwardly from the retractable position shown in FIG. 5 to the extended position shown in FIG. 6. As also shown, the blade members in this embodiment have a somewhat different shape than the earlier embodiments. The blade shapes in all of the embodiments of the present invention may be altered from the illustrated versions.

Figure 7:
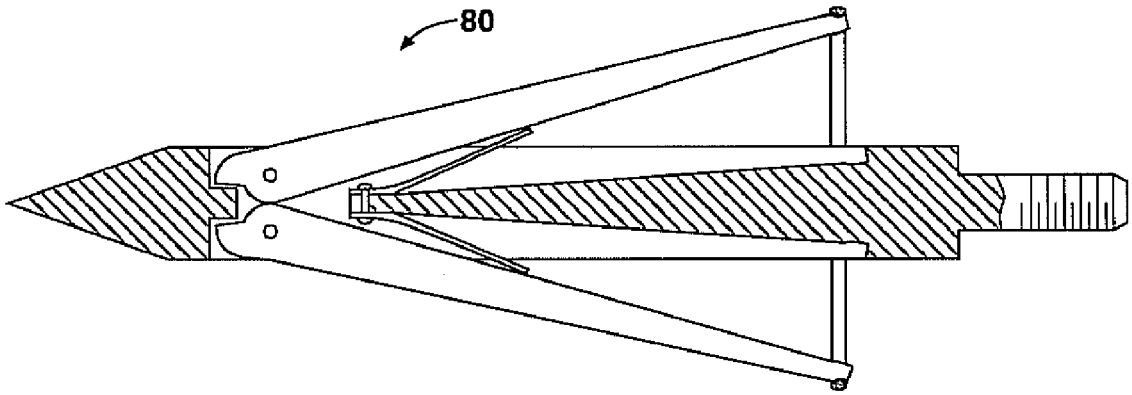
FIG. 7 is a cross sectional side view of a broadhead according to a fourth embodiment of the present invention with the blade members in a retracted position.
Figure 8:
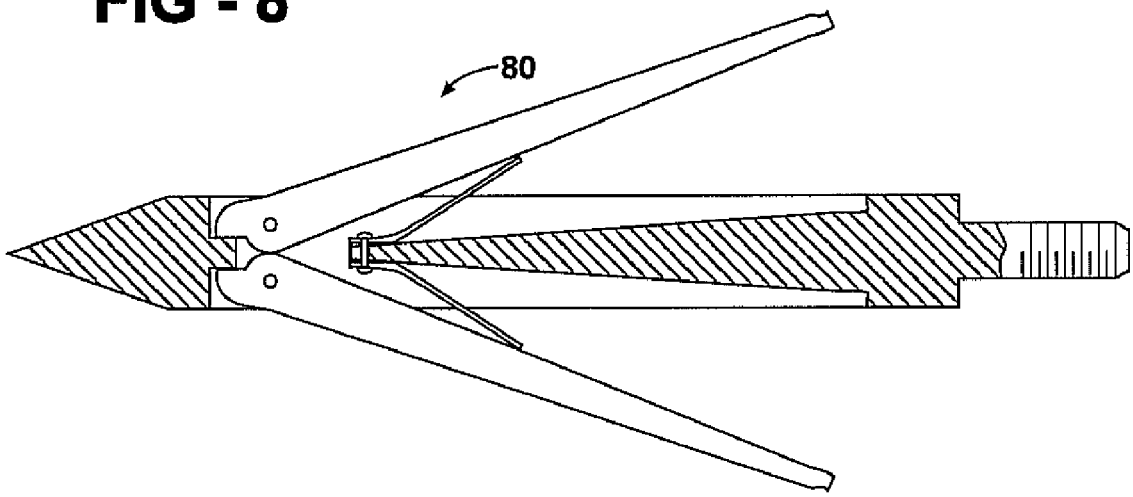
FIG. 8 is a view similar to FIG. 8 with the blade members in an extended position.

Referring now to FIGS. 7 and 8, a fourth embodiment of an arrowhead according to the present invention is generally shown at 80. The biasing member takes the form of a pair of leaf springs that urge the blade members outwardly from the retractable position shown in FIG. 7 to the extended position shown in FIG. 8. The biasing members may also take other forms, for example, the leaf springs may interconnect with the ferrule body ahead of the pivotal interconnection between the blade members and the ferrule and extend rearwardly to a position between the blade members. Other versions will also be clear to those of skill in the art. As also will be clear to those of skill in the art, the blade members may be disposed more closely to the ferrule in the retractable position than illustrated in the various embodiments. The blade members may also be shaped so as to nest more closely to the ferrule and/or the ferrule body may have slots into which the blade members are partially disposed when in the retractable position.

Preferably, the various embodiments of the present invention utilize only the biasing member or members to urge and hold the blade members into the extended position. No latch or locking element is provided to hold the blade members in the extended position. Therefore, the blade members are free to move back to the retracted position when the arrowhead encounters a dense material such as bone.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

I claim:

1. A broadhead for an arrow having a shaft, the broadhead comprising:

a ferrule having a rearward end configured for attachment to the shaft and an opposite forward end with a ferrule body extending therebetween;

a first blade member having a first end pivotally interconnected with the ferrule body and an opposite second end, the first blade member having a retracted position wherein the second end is spaced from the ferrule body at a first distance and an extended position wherein the second end is spaced from the ferrule body by a distance which is greater than the first distance;

a second blade member having a first end pivotally interconnected with the ferrule body and an opposite second end, the first blade member having a retracted position wherein the second end is spaced from the ferrule body at a first distance and an extended position wherein the second end is spaced from the ferrule body by a distance which is greater than the first distance; and at least one biasing member biasing the first and second blade members towards the extended positions, the biasing member being the only element operable to hold the blade members in the extended position.

2. A broadhead in accordance with claim 1, wherein:

the pivotal interconnection between the first blade member and the ferrule body is at a fixed position relative to the ferrule body; and the pivotal interconnection between the second blade member and the ferrule body being at a fixed position relative to the ferrule body.

3. A broadhead in accordance with claim 2, wherein:

the pivotal interconnection between the first blade member and the ferrule body and the pivotal interconnection between the second blade member and the ferrule body are substantially equidistant from the forward end of the ferrule.

4. A broadhead in accordance with claim 1, wherein:

the first ends of the first and second blade members are forward ends and the second ends are rearward ends.

5. A broadhead in accordance with claim 1, wherein:

each blade member include a travel limit interacting with the ferrule body so as to define a maximum distance between the second end of the blade member and the ferrule body.

6. A broadhead in accordance with claim 5, wherein the travel limit is a tab extending from the first end of each blade member, the ferrule body having an abutment that is engaged by the tabs.

7. A broadhead in accordance with claim 1, further comprising:

a retaining element engaging the blade members to maintain the blade members in the retracted position.

8. A broadhead in accordance with claim 7, wherein:

the retaining element is a ring engaging the second end of the blade members.

9. A broadhead in accordance with claim 1, wherein:

the biasing member is a coil spring.

10. A broadhead in accordance with claim 1, wherein the at least one biasing member comprises two biasing members, each member biasing one of the blade members.

11. A broadhead for an arrow having a shaft, the broadhead comprising:

a ferrule having a rearward end configured for attachment to the shaft and an opposite forward end with a ferrule body extending therebetween, the forward end of the ferrule defining the forward tip of the arrow and being fixed with respect to the ferrule body;

a first blade member having a forward end pivotally interconnected with the ferrule body and an opposite rearward end, the first blade member having a retracted position wherein the rearward end is spaced from the ferrule body at a first distance and an extended position wherein the rearward end is spaced from the ferrule body by a distance which is greater than the first distance, the pivotal interconnection between the first blade member and the ferrule body being at a fixed position relative to the ferrule body;

a second blade member having a forward end pivotally interconnected with the ferrule body and an opposite rearward end, the second blade member having a retracted position wherein the rearward end is spaced from the ferrule body at a first distance and an extended position wherein the rearward end is spaced from the ferrule body by a distance which is greater than the first distance, the pivotal interconnection between the second blade member and the ferrule body being at a fixed position relative to the ferrule body; and at least one biasing member biasing the first and second blade members towards the extended positions.

12. A broadhead in accordance with claim 11, wherein:

the pivotal interconnection between the first blade member and the ferrule body and the pivotal interconnection between the second blade member and the ferrule body are substantially equidistant from the forward end of the ferrule.

13. A broadhead in accordance with claim 11, wherein:

each blade member includes a travel limit interacting with the ferrule body so as to define a maximum distance between the rearward end of the blade member and the ferrule body.

14. A broadhead in accordance with claim 13, wherein the travel limit is a tab extending from the first end of each blade member, the ferrule body having an abutment that is engaged by the tabs.

15. A broadhead in accordance with claim 11, further comprising:

a retaining element engaging the blade members to maintain the blade members in the retracted position.

16. A broadhead in accordance with claim 15, wherein:

the retaining element is a ring engaging the second end of the blade members.

17. A broadhead in accordance with claim 11, wherein:

the biasing member is a coil spring.

* * * * *

UNITED STATES PATENT AND TRADEMARK OFFICE

CERTIFICATE OF CORRECTION

PATENT NO. : 8,043,177 B2
APPLICATION NO. : 12/168189
DATED : October 25, 2011
INVENTOR(S) : Edward Flanagan It is certified that error appears in the above-identified patent and that said Letters Patent is hereby corrected as shown below:

Col. 2, line 46: replace “FIG. 8 with” with -- FIG. 7 with --
Col. 3, line 8: replace “to spaced” with -- to be spaced --
Col. 3, line 47: replace “form or” with -- form of --

Signed and Sealed this
Thirty-first Day of January, 2012

David J. Kappos

David J. Kappos
*Director of the United States Patent and Trademark Office*